US007871279B2

(12) United States Patent
Litteer

(10) Patent No.: US 7,871,279 B2
(45) Date of Patent: Jan. 18, 2011

(54) SLIDING LOCKOUT KEY

(75) Inventor: Andrew Adams Litteer, Clay, NY (US)

(73) Assignee: Cooper Technologies Company, Houston, TX (US)

( * ) Notice: Subject to any disclaimer, the term of this patent is extended or adjusted under 35 U.S.C. 154(b) by 37 days.

(21) Appl. No.: 12/273,524

(22) Filed: Nov. 18, 2008

(65) Prior Publication Data

US 2010/0124856 A1 May 20, 2010

(51) Int. Cl.
*H01R 13/644* (2006.01)

(52) U.S. Cl. ..... 439/139

(58) Field of Classification Search ..... 439/133, 439/139, 135, 677, 142; 174/67
See application file for complete search history.

(56) References Cited

U.S. PATENT DOCUMENTS 866,105 A 9/1907 Whittlesey ..... 439/139
4,970,349 A * 11/1990 Jones ..... 174/67
5,066,238 A 11/1991 Shieh ..... 439/139
5,096,432 A 3/1992 Cullen et al. ..... 439/139
6,545,218 B1 * 4/2003 Blaess ..... 174/67
7,080,889 B2 * 7/2006 Ling et al. ..... 200/334

OTHER PUBLICATIONS

Blaine R. Coperheaver, Search Report and Written Opinion of the International Searching Authority for PCT/US2008/085132, pp. 1-8.

* cited by examiner

*Primary Examiner*—Alexander Gilman
(74) *Attorney, Agent, or Firm*—King & Spalding LLP

(57) ABSTRACT

Receptacles configured to securely mate with hazardous area plugs are provided. The receptacles include a housing, a locking plate, and a sliding lockout key. The sliding lockout key prevents the locking plate from rotating when the receptacle and plug are disconnected or when a standard plug is inserted into the receptacle. When the proper plug is inserted into the receptacle, the sliding key portion is depressed and allows rotation of the locking plate. Upon rotation, pins from the plug contact internal pins of the receptacle and make an electrical connection.

16 Claims, 8 Drawing Sheets

SLIDING LOCKOUT KEY

TECHNICAL FIELD

The present application relates generally to receptacles for use with hazardous location plugs. Specifically, the receptacles include a sliding key portion that aids in preventing the use of standard plugs with the receptacles.

BACKGROUND OF THE INVENTION

Hazardous location plugs and receptacles are typically used in hazardous areas where power is to be supplied to electrical equipment, such as compressors, motors, motor-generator sets, tools, lighting systems, and similar devices. The plugs and receptacles may be used, for example, in military applications, aerospace applications, damp or corrosive areas, armored applications, on board ships, or in other harsh or hazardous environments.

Conventional receptacles for use with hazardous location plugs typically include a rotatable locking plate adapted to receive the contact pins of the plug, contacts positioned behind the locking plate and within the receptacle, and a number of fixed key portions surrounding the locking plate. The hazardous location plug is inserted into the locking plate completely. The plug is then rotated in a clockwise direction to engage the internal contacts of the receptacle and to complete an electrical circuit.

Conventional hazardous location plugs also include grooves that fit over the fixed key portions of the receptacle. Once the plug is inserted into the locking plate and the locking plate is depressed and rotated, the plug is locked into place via a ledge on the fixed key portions positioned in the grooves. The locking of the plug in place helps prevent accidental disengagement (which could lead to sparking) of the plug from the receptacle.

To safely disengage the hazardous location plug from the hazardous location receptacle, the plug must be rotated in a counter-clockwise direction to disengage the plug's contact pins from the receptacle contacts and to break the electrical circuit. Any sparking that may occur from the break in the electrical circuit is confined within the receptacle. In addition, the fixed key portions do not lock the plug in place upon rotation in the counter-clockwise direction. The plug can then be removed from the locking plate of the receptacle.

One deficiency in the design of conventional hazardous location receptacles is that any standard plug may be inserted into the receptacle. Similar to the insertion of hazardous location plugs into the receptacle, standard plugs can be inserted into the locking plate, and the locking plate can be depressed and rotated to contact the contacts in the receptacle. The difference, however, is that standard plugs generally have a smaller diameter than hazardous location plugs and lack the grooves that fit over the fixed key portions to lock the plug in place. Therefore, standard plugs can easily be pulled out of the receptacle, which could lead to sparking and result in an explosion.

Therefore, a need exists in the art for a receptacle that can prevent the use of non-hazardous location plugs with a receptacle in hazardous areas.

SUMMARY OF THE INVENTION

The receptacles described herein can aid in preventing the use of standard plugs with a hazardous location receptacle, thus minimizing the possibility of sparking from using standard plugs.

In one aspect of the invention, the receptacles of the present invention include a housing having a cavity, a locking plate positioned within the cavity, and a sliding key portion movably coupled to the locking plate. In certain aspects, the sliding key portion may be coupled to the locking plate by a spring. The spring facilitates movement of the sliding key portion when a hazardous area plug is inserted into the receptacle. The sliding key portion includes a ledge that prevents the locking plate from rotating unless the sliding key portion is depressed, and thus prevents the use of standard plugs with the receptacle since the housing diameter of standard plugs is not large enough to depress the sliding key portion upon insertion into the receptacle housing. Upon insertion of the plug into the receptacle, the spring compresses and the ledge of the sliding key shifts into a groove in the receptacle housing and allows the locking plate to then rotate. Upon rotation of the locking plate, the pins of the plug contact internal pins of the receptacle and make an electrical connection.

In another aspect of the invention, the sliding key portion may be movably coupled to the interior wall of the receptacle housing.

In yet another aspect of the invention, systems of the present invention include a receptacle mated with a hazardous area plug.

These and other aspects, objects, and features of the invention will become apparent to those having ordinary skill in the art upon consideration of the following detailed description of exemplary embodiments exemplifying the best mode for carrying out the invention as presently perceived.

DETAILED DESCRIPTION OF THE INVENTION

The application discloses receptacles having a sliding lockout key for preventing the use of standard plugs with the receptacles. The receptacles can be used for both general purposes and in hazardous areas.

Figure 1A:
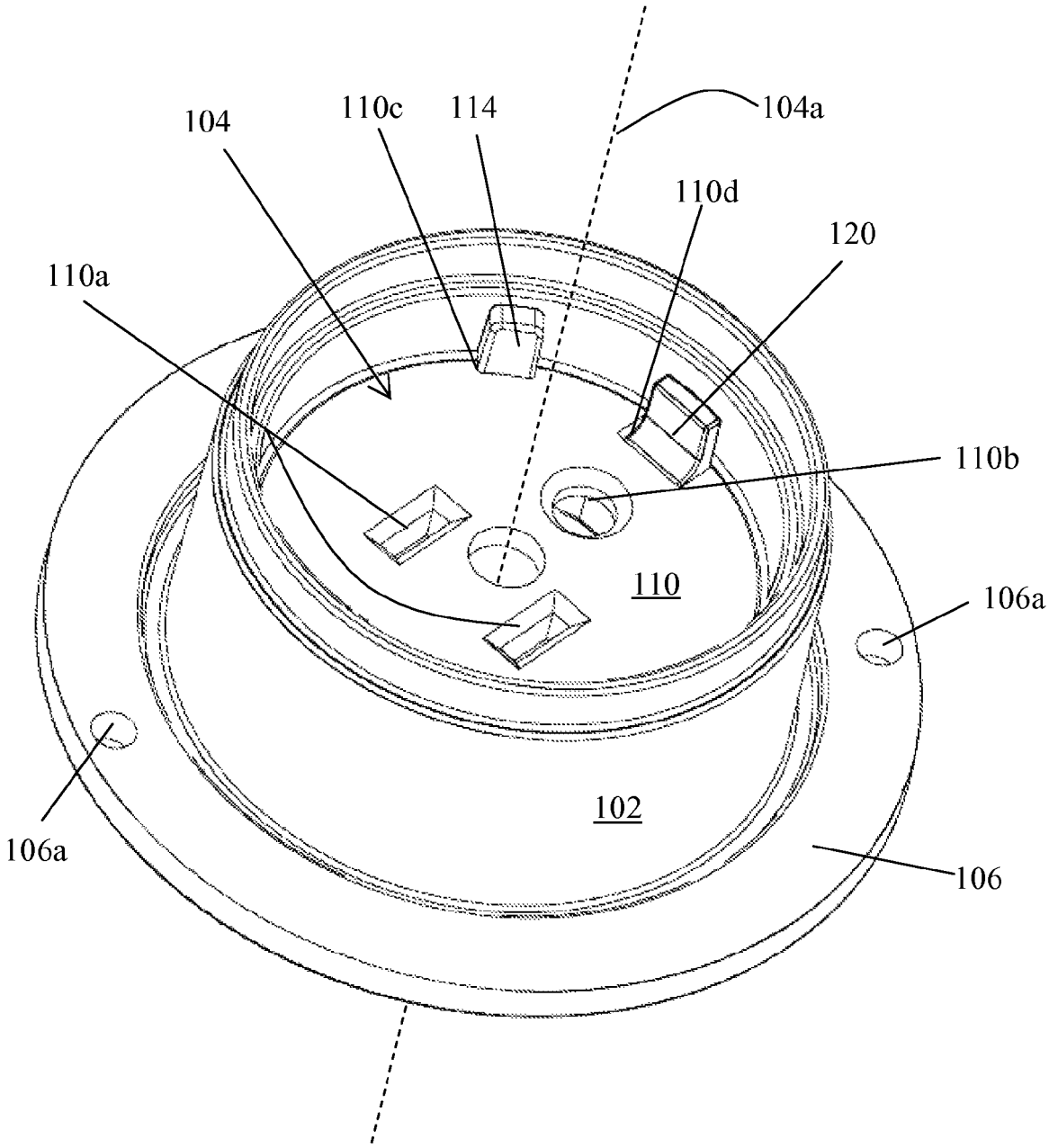
FIG. 1A is a perspective view of a receptacle for use in hazardous areas according to an exemplary embodiment.
Figure 1B:
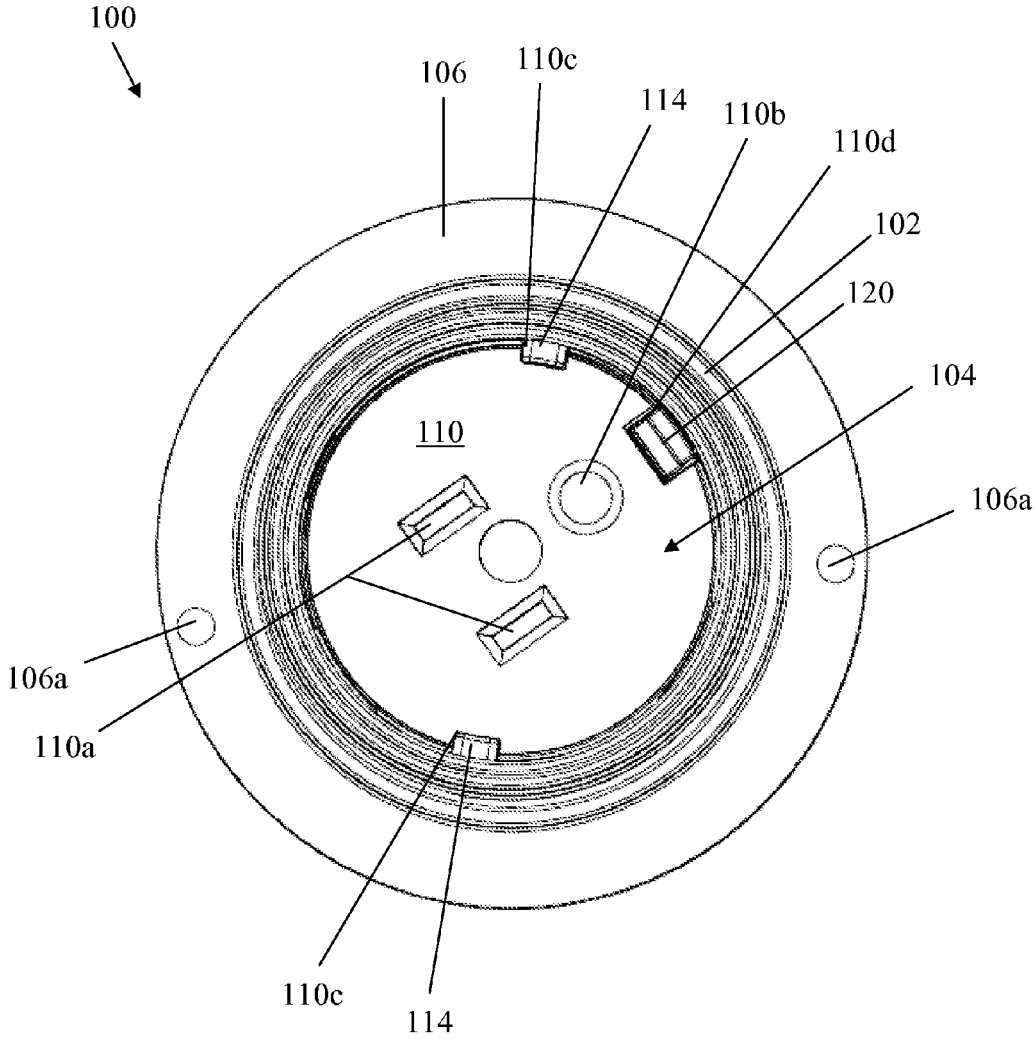
FIG. 1B is a top view of the receptacle shown in FIG. 1A according to an exemplary embodiment.
Figure 2:
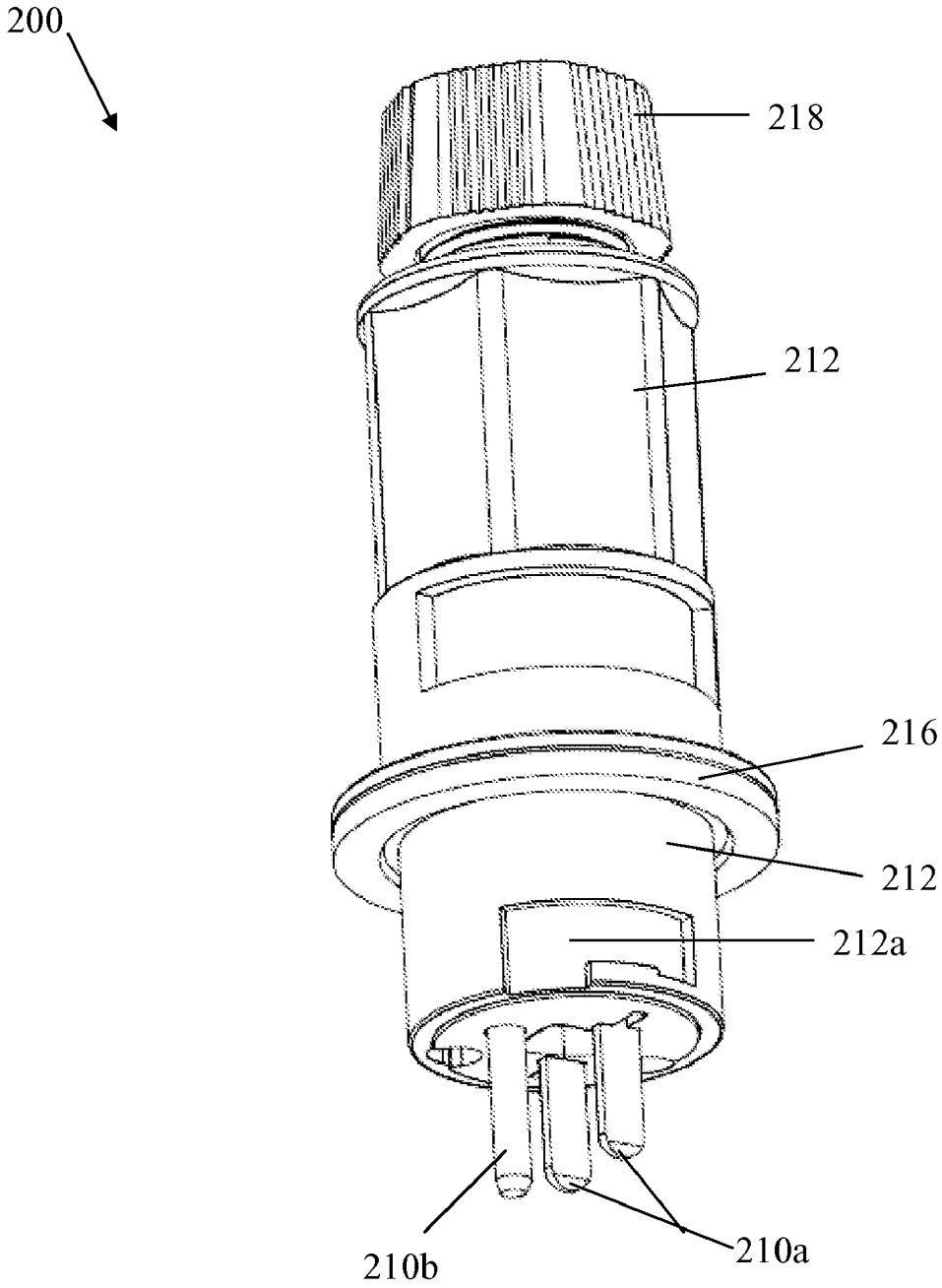
FIG. 2 is a perspective view of a plug for use in hazardous areas according to an exemplary embodiment.

FIGS. 1A and 1B are perspective and top views of a receptacle 100 according to an exemplary embodiment. The receptacle 100 includes a cylindrical housing 102 having a cavity 104 configured to receive a hazardous location plug 200 (FIG. 2). The housing 102 includes a mounting flange 106 at an end opposite the cavity 104. The mounting flange 106 includes apertures 106*a* for receiving fasteners, such as screws (not shown), for mounting the receptacle 100 to a surface or box (not shown).

The receptacle 100 also includes a rotatable locking plate 110 positioned in the cavity 104 of the housing 102. The locking plate 110 is coupled to three springs (not shown) and a contact body (not shown) that allows the locking plate 110 to move in a vertical direction along a central axis 104*a* upon compression of the three springs. The locking plate 110 is loosely fitted within the housing 102, and thus can also rotate axially about the central axis 104*a* within the housing 102. The locking plate 110 is circular to correspond with the cavity 104 of the housing 102 and includes two parallel rectangular slots 110*a* for receiving contact pins 210*a* (FIG. 2) of the plug 200. The locking plate 110 also includes a circular opening 110*b* positioned below and between the slots 110*a* for receiving a ground pin 210*b* (FIG. 2) of the plug 200. In alternative embodiments, the slots 110*a* and the opening 110*b* can be shaped and arranged in any suitable manner to accommodate the shape and arrangement of the contact and ground pins of a desired plug to be used.

The locking plate 110 also includes two notches 110*c* located at a perimeter of the locking plate 110 and positioned opposite each other. The notches 110*c* are configured to receive two fixed key portions 114. The fixed key portions 114 are fixed on the interior wall of the cylindrical housing 102. The fixed key portions 114 do not extend significantly below the locking plate 110. When the plug 200 is inserted into the locking plate 110, the locking plate is depressed below the fixed key portions 114 to allow the locking plate 110 to rotate at a position below the fixed key portions 114.

The locking plate 110 further includes a notch 110*d* located at a perimeter of the locking plate 110. The notch 110*d* can be positioned at any suitable location on the perimeter of the locking plate 110 to accommodate the plug 200 to be used in conjunction with the receptacle 100. The notch 110*d* is configured to receive a sliding key 120, which will be described in further detail hereinafter with respect to FIG. 1D.

Figure 1C:
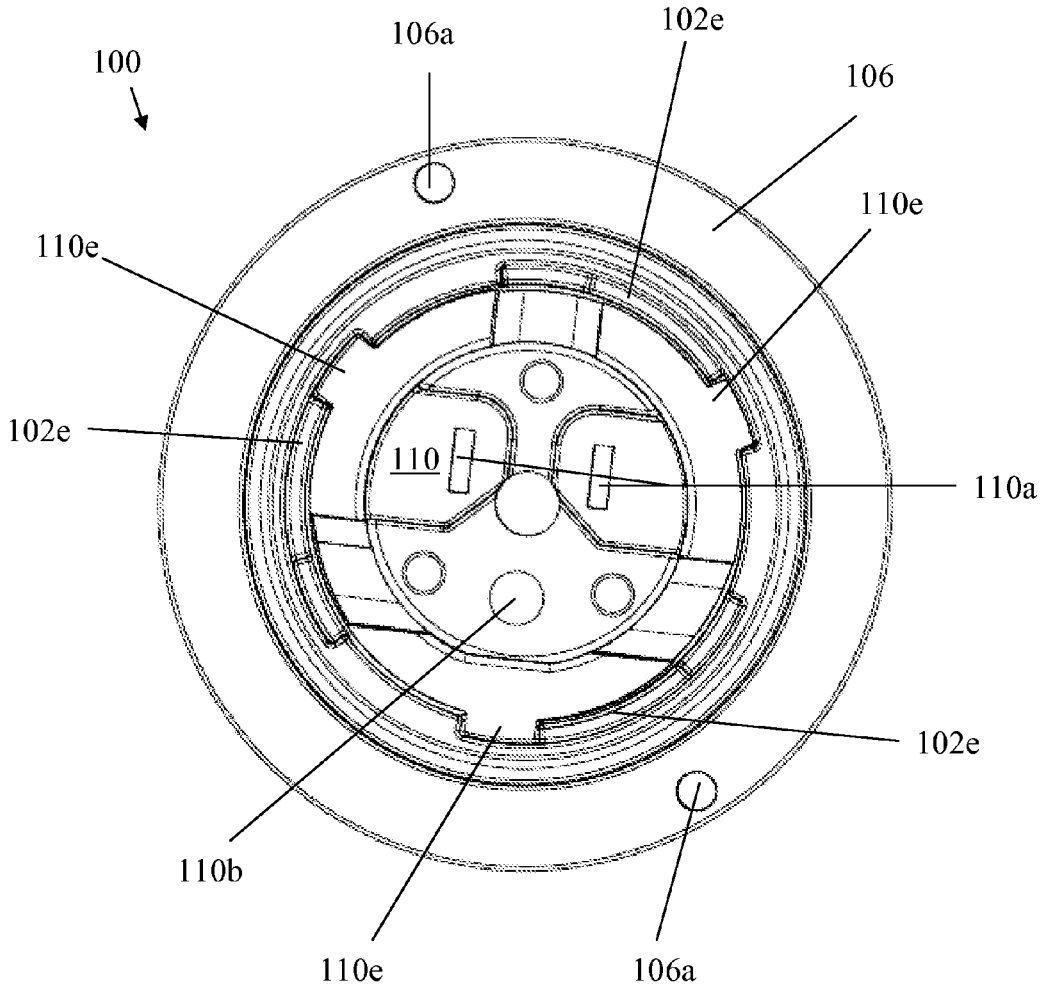
FIG. 1C is a bottom view of the receptacle shown in FIG. 1A according to an exemplary embodiment.

Referring to FIG. 1C, a bottom view of the exemplary receptacle 100 is illustrated. The housing 102 of the receptacle 100 includes three grooves 102*e*. The locking plate 110 comprises three extensions 110*e* corresponding to the position of the grooves 102*e* on the housing 102. When the plug 200 is inserted in the locking plate 110 and the locking plate 110 is depressed and rotated, each of the extensions 110*e* moves within the grooves 102*e*. In alternative exemplary embodiments, any number of extensions 110*e* and corresponding grooves 102*e* may be included in the receptacle 100. In certain alternative embodiments, the receptacle 100 may not include any extensions 110*e* and corresponding grooves 102*e*.

Figure 1D:
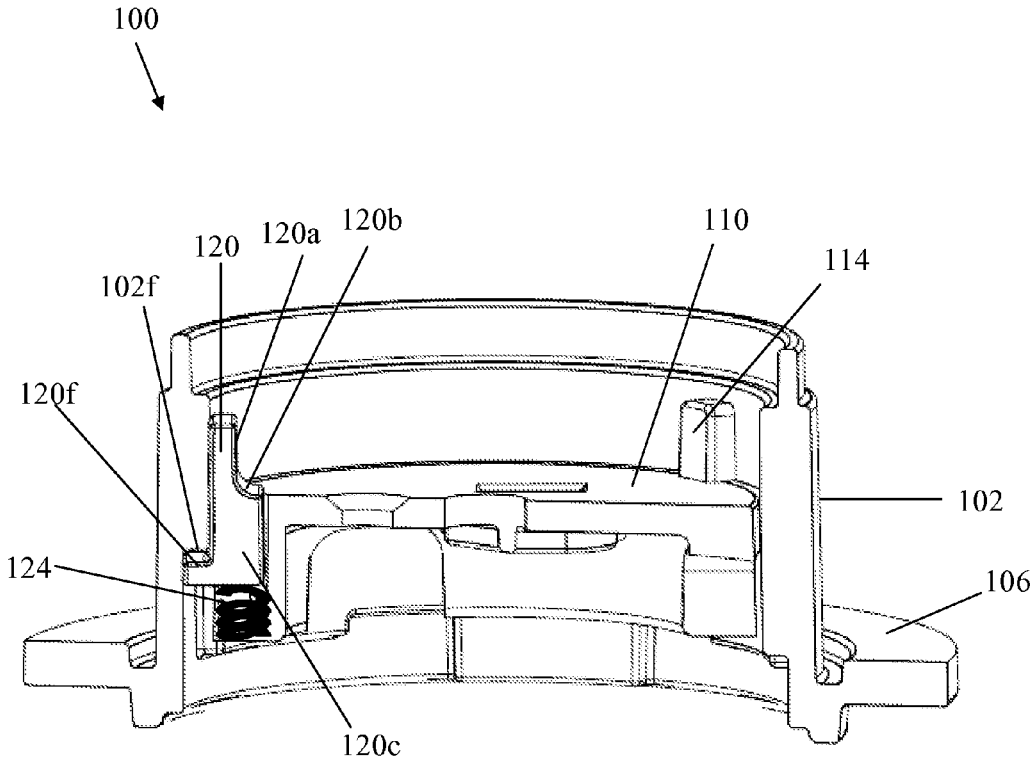
FIG. 1D is a side cross-sectional view of the receptacle shown in FIG. 1A according to an exemplary embodiment.
Figure 1E:
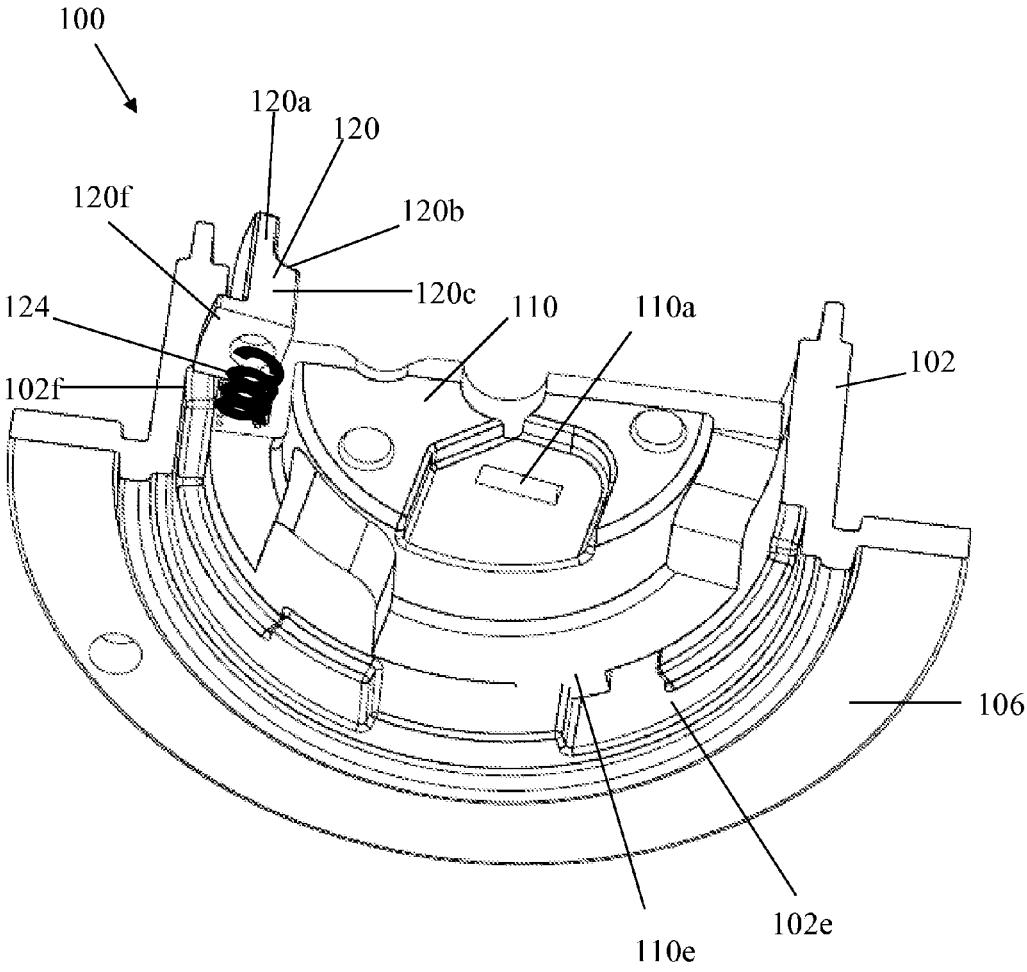
FIG. 1E is a bottom perspective view of the cross-section of the receptacle shown in FIG. 1D according to an exemplary embodiment.

Referring to FIGS. 1D and 1E, side and bottom cross-sectional views of the exemplary receptacle 100 are illustrated, respectively. The receptacle 100 comprises a spring 124 securing the sliding key 120 to the locking plate 110. The sliding key 120 includes a narrow top portion 120*a*, a rounded transition portion 120*b*, a wider bottom portion 120 *c*, and a ledge 120*f*. When the spring 124 is in the extended position (not shown), the top portion 120*a* and the rounded transition portion 120*b* of the sliding key 120 extend above the locking plate 110 into the cavity 104. When the sliding key 120 is in this position, the ledge 120*f* is positioned in a recess (not shown) in the housing 102 such that the ledge can only move in the vertical direction, thus preventing the locking plate 110 from rotating. The recess is also configured with a lip (not shown) so as to prevent the sliding key 120 from coming completely out of the housing 102 and into the cavity 104.

When a hazardous area plug 200 (FIG. 2) is inserted into the receptacle 100, the plug 200 engages the rounded transition portion 120*b* of the sliding key 120 and the sliding key 120 shifts downward in the recess of the housing 102 and the spring 124 is compressed, as shown in FIGS. 1D and 1E. Upon compression of the spring 124, the ledge 120*f* engages a horizontal groove 102*f* in the housing 102. When the ledge 120*f* engages the groove 102*f*, the locking plate 102 can then be rotated within the groove 120*f*.

FIG. 2 illustrates a perspective view of a plug 200 for use in conjunction with the receptacle 100 (FIGS. 1A-1E) according to an exemplary embodiment. The plug 200 can be any plug suitable for use in hazardous areas. The plug 200 comprises two contact pins 210*a* and a ground pin 210*b* extending from a cylindrical housing 212. The housing 212 comprises two grooves 212*a* suitably spaced apart to receive the two fixed key portions 114 of the receptacle 100.

The plug 200 also comprises a gasket 216 to seal the connection between the plug 200 and the receptacle 100 to protect the electrical connection. As a result, the gasket 216 provides ingress protection required by the National Electrical Code (NEC). The plug 200 further comprises a gland nut 218 opposite the contact pins 210*a* and the ground pin 210*b*. The gland nut 218 is used to connect wiring comprising two conductors and a ground conductor (not shown) to the pins 210*a*, 210*b* in the interior of the plug 200.

Figure 3A:
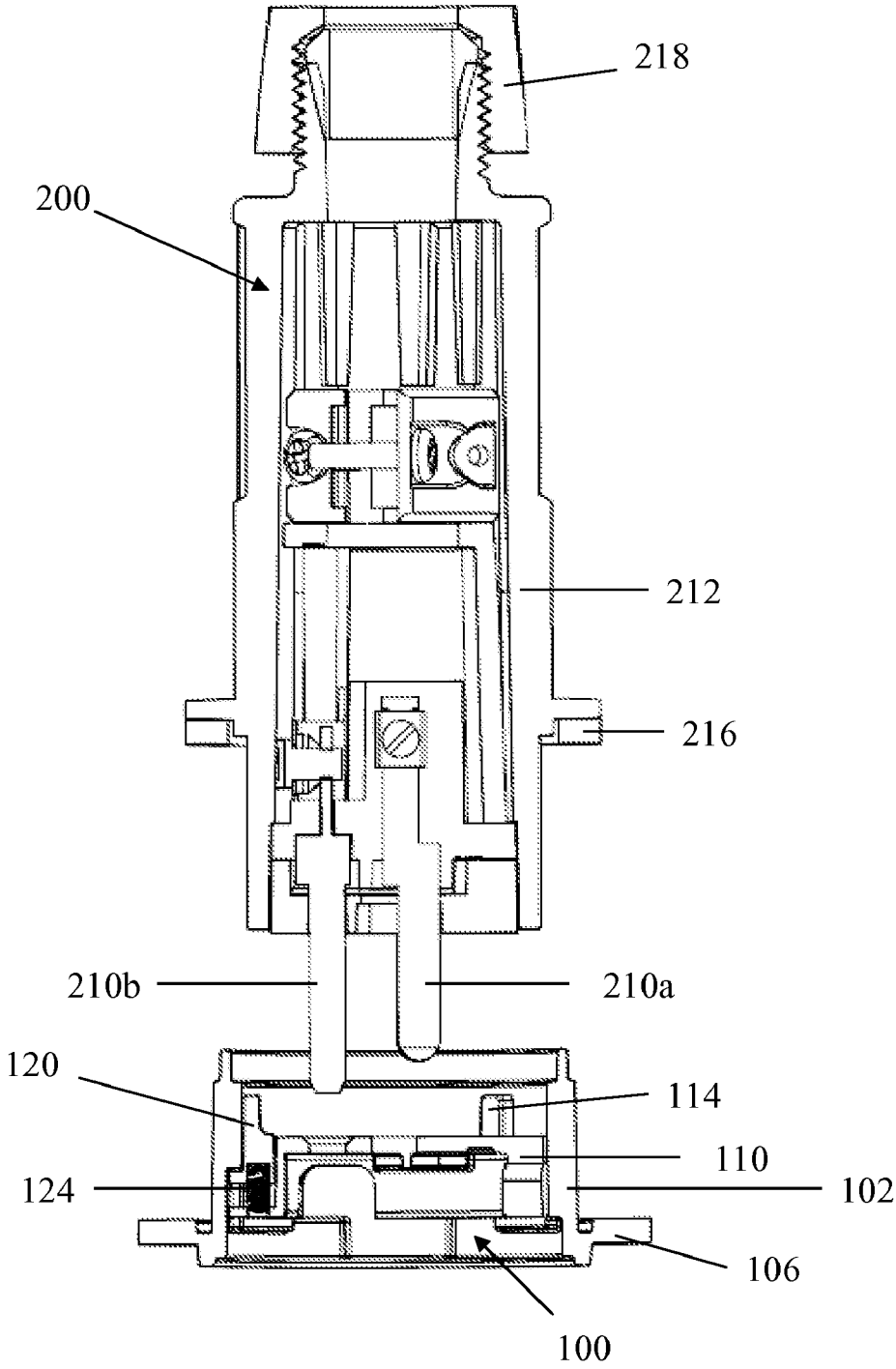
FIG. 3A is a sectional view of a system showing the receptacle of FIG. 1A and the plug of FIG. 2 disconnected according to an exemplary embodiment.

FIG. 3A illustrates the receptacle 100 (FIGS. 1A-1E) and the plug 200 (FIG. 2) in a disconnected state. At this stage, the spring 124 is not compressed and the sliding key 120, as well as the fixed key portions 114, prevents rotation of the locking plate 110. However, without the sliding key 120, a standard plug (not shown) could be inserted into the receptacle 100, the locking plate 110 depressed to disengage the fixed key portions 114 from the notches 110*c*, and the locking plate 110 rotated to complete an electrical circuit. The sliding key 120 prevents the use of a standard plug with the receptacle 100 because standard plugs do not have a diameter large enough to depress the sliding key 120 and allow rotation of the locking plate 110.

Figure 3B:
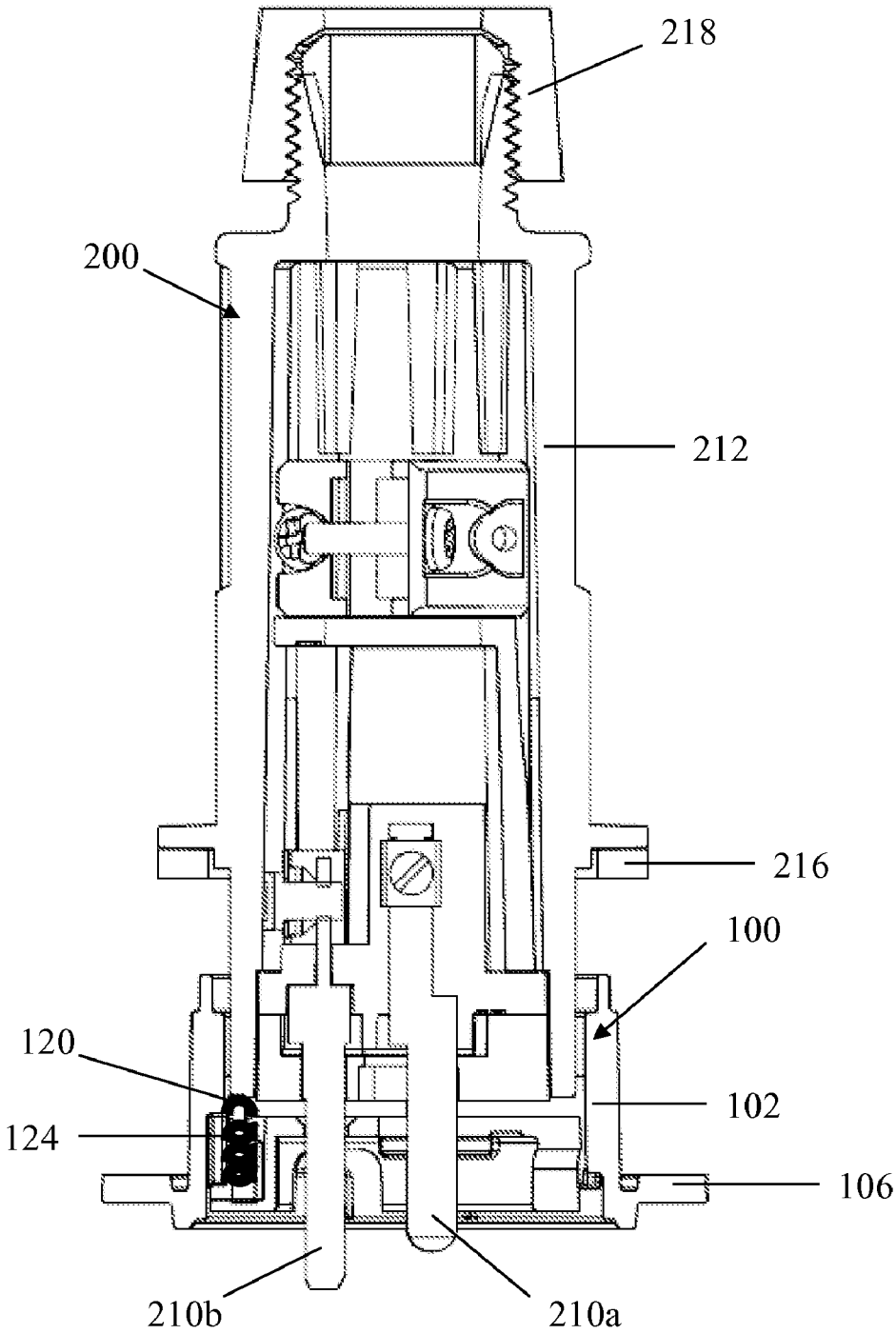
FIG. 3B is a sectional view of the system of FIG. 3A showing the receptacle of FIG. 1A and the plug of FIG. 2 connected according to an exemplary embodiment.

FIG. 3B illustrates the receptacle 100 mated with the plug 200, whereby the contact pins 210*a* and the ground pin 210*b* of the plug 200 are inserted into the rectangular slots 110*a* and the circular opening 110*b*, respectively, of the receptacle 100, and an electrical circuit is complete. Upon insertion of the plug 200 into the receptacle 100, the housing 212 depresses the sliding key 120, thereby compressing the spring 124. At this stage, the ledge 120*f* of the sliding key 120 slidably engages the groove 102*f* in the housing 102. The locking plate 110 is also depressed below the fixed key portions 114 to allow the locking plate 110 to rotate at a position below the fixed key portions 114. The sliding key 120 and the locking plate 110 can then simultaneously rotate within the housing 102 at the position below the fixed key portions 114. Upon rotation, the contact pins 210*a* and the ground pin 210*b* of the plug 200 contact the internal contacts (not shown) of the receptacle 100, thereby completing an electrical circuit. Also upon rotation, the extensions 110*e* of the locking plate 110 engage the grooves 102*e* of the housing 102 and locks the plug 200 in place. In addition, the grooves 212*a* on the plug 200 accept the fixed key portions 114 upon rotation of the locking plate 110. Once the fixed key portions 114 have engaged the grooves 212*a*, the plug 200 cannot be removed without rotation of the locking plate 110 in a direction to break the electrical circuit first.

To disengage the receptacle 100 from the plug 200, the plug 200 and the locking plate 110 are rotated in a direction so as to disengage the extensions 110*e* from the grooves 102*e* and break the electrical circuit. At this stage, the locking plate 110 can move vertically within the receptacle 100. Also, the fixed key portions 114 shift within the grooves 212*a* to allow disconnection of the plug 200 from the receptacle 100. Any sparking resulting from the break in the electrical circuit is contained within the receptacle 100 and below the locking plate 110. After disengagement of the extensions 110*e* from the grooves 102*e* and the fixed key portions 114 from the grooves 212*a*, the plug 200 can be safely removed from the receptacle 100. The spring 124 also decompresses and shifts the sliding key 120 vertically so as the prevent the locking plate 110 from rotating.

The diameter of the cavity of the receptacles of the present invention has a diameter that is larger than the outer diameter of the housing of standard plugs, thereby making standard plugs unable to compress the sliding key. As a result, the locking plate of the receptacle cannot be rotated such that the pins of the standard plug contact the internal contacts of the receptacle. Thus, an improved receptacle is realized that prevents the use of standard plugs with the receptacle.

Therefore, the present invention is well adapted to attain the ends and advantages mentioned as well as those that are inherent therein. The particular embodiments disclosed above are illustrative only, as the present invention may be modified and practiced in different but equivalent manners apparent to those having ordinary skill in the art and having the benefit of the teachings herein. Having described some exemplary embodiments of the present invention, that the use of alternate receptacle housing configurations and hazardous area plugs is within the purview of those having ordinary skill in the art. Additionally, while the present application generally illustrates cylindrical plugs and receptacles, it is understood that a number of other non-circular configurations may be used. Furthermore, while the sliding key is shown as being coupled to the locking plate, in alternative embodiments, the sliding key can be slidably coupled to the interior wall of the receptacle housing.

While numerous changes may be made by those having ordinary skill in the art, such changes are encompassed within the scope and spirit of the invention as defined by the appended claims. Furthermore, no limitations are intended to the details of construction or design herein shown, other than as described in the claims below. It is therefore evident that the particular illustrative embodiments disclosed above may be altered or modified and that all such variations are considered within the scope and spirit of the claimed invention. The terms in the claims have their plain, ordinary meaning unless otherwise explicitly and clearly defined by the patentee.

What is claimed is:

1. A receptacle, comprising:

a housing comprising a cavity having a central axis;

a locking plate positioned within the cavity, wherein the locking plate is movable linearly along the central axis and rotatable axially about the central axis; and a movable key positioned within the housing in a movable relationship between a first position and a second position with respect to the locking plate, wherein the movable key prevents the locking plate from rotating when in the first position and does not prevent the locking plate from rotating when in the second position.

2. The receptacle of claim 1, wherein the movable key is coupled to the locking plate and adjacent an interior wall of the housing.

3. The receptacle of claim 1, wherein the housing further comprises a first groove extending below the locking plate, wherein the locking plate comprises an extension extending outwardly from an edge of the locking plate, and wherein the extension moves within the first groove when the locking plate is rotated within the cavity.

4. The receptacle of claim 1, wherein the housing further comprises a second groove extending below the locking plate, wherein the movable key comprises a ledge, wherein the ledge movable shifts within the second groove when in the second position.

5. The receptacle of claim 1, further comprising a spring coupling the movable key to the locking plate, wherein the spring is biases the movable key to the first position.

6. The receptacle of claim 1, wherein the housing further comprises a fixed key portion coupled to the interior wall of the housing, wherein the locking plate further comprises a corresponding notch to receive the fixed key portion, wherein engagement of the fixed key portion with the notch prevents rotation of the locking plate.

7. The receptacle of claim 1, wherein the movable key and the locking plate rotate simultaneously when the movable key is in the second position.

8. A system, comprising:

a receptacle comprising a housing having a cavity having a central axis, a locking plate positioned within the cavity, the locking plate movable linearly along the central axis and rotatable axially about the central axis, and a movable key positioned within the housing in a movable relationship between a first position and a second position with respect to the locking plate, wherein the movable key prevents the locking plate from rotating when in the first position and does not prevent the locking plate from rotating when in the second position; and a plug configured to mate with the receptacle.

9. The system of claim 8, wherein the movable key is coupled to the locking plate and adjacent an interior wall of the housing.

10. The system of claim 8, wherein the housing further comprises a first groove extending below the locking plate, wherein the locking plate comprises an extension extending outwardly from an edge of the locking plate, and wherein the extension moves within the first groove when the locking plate is rotated within the cavity.

11. The system of claim 8, wherein the housing further comprises a second groove extending below the locking plate, wherein the movable key comprises a ledge, wherein the ledge movable shifts within the second groove when in the second position.

12. The system of claim 8, further comprising a spring coupling the movable key to the locking plate, wherein the spring is biases the movable key to the first position.

13. The system of claim 8, wherein the housing further comprises a fixed key portion coupled to the interior wall of the housing, wherein the locking plate further comprises a corresponding notch to receive the fixed key portion, wherein engagement of the fixed key portion with the notch prevents rotation of the locking plate.

14. The system of claim 8, wherein the movable key and the locking plate rotate simultaneously when the movable key is in the second position.

15. The system of claim 8, wherein the receptacle comprises first contact pins positioned below the locking plate, wherein the plug comprises a plug housing and second contact pins protruding at least partially therefrom, and wherein the second contact pins contact the first contact pins when the plug is inserted into the receptacle and the locking plate rotated, thereby making an electrical connection.

16. The system of claim 8, wherein the plug depresses the movable key upon mating and allows the locking plate and movable key to rotate.

* * * * *